US011064744B1

(12) United States Patent
Palacios et al.

(10) Patent No.: US 11,064,744 B1
(45) Date of Patent: Jul. 20, 2021

(54) FACE MASK

(71) Applicants: Caroline Kim Palacios, Sunland, CA (US); Sukhui Kim, Sunland, CA (US)

(72) Inventors: Caroline Kim Palacios, Sunland, CA (US); Sukhui Kim, Sunland, CA (US)

( * ) Notice: Subject to any disclaimer, the term of this patent is extended or adjusted under 35 U.S.C. 154(b) by 0 days.

(21) Appl. No.: 17/009,475

(22) Filed: Sep. 1, 2020

Related U.S. Application Data

(60) Provisional application No. 63/054,195, filed on Jul. 20, 2020.

(51) Int. Cl.
*A41D 13/11* (2006.01)
*A42B 3/22* (2006.01)
*A41D 31/12* (2019.01)

(52) U.S. Cl.
CPC ..... *A41D 13/1107* (2013.01); *A41D 13/1161* (2013.01); *A41D 13/11* (2013.01); *A41D 13/1123* (2013.01); *A41D 13/1176* (2013.01); *A41D 13/1192* (2013.01); *A41D 31/125* (2019.02); *A41D 2500/30* (2013.01); *A42B 3/22* (2013.01); *A42B 3/224* (2013.01)

(58) Field of Classification Search
CPC ..... A41D 13/1107; A41D 13/1161; A41D 13/1192; A41D 13/1176; A41D 13/11; A41D 13/1123; A41D 31/125; A41D 2500/30; A42B 3/22; A42B 3/225
USPC ..... 2/9; 128/863
See application file for complete search history.

(56) References Cited

U.S. PATENT DOCUMENTS 167,543 A * 9/1875 Kleinert ..... A41D 13/11 2/206
772,148 A * 10/1904 Muffler ..... A41D 13/11 2/206
1,709,936 A * 4/1929 Drew ..... A61F 7/02 604/303
1,990,199 A * 2/1935 Nemzek ..... A41D 13/11 2/206
2,116,241 A * 5/1938 Heumann ..... A61F 5/56 128/863
2,556,589 A * 6/1951 Le Duc ..... A41D 13/11 128/206.12
4,250,577 A * 2/1981 Smith ..... A61F 9/029 2/427

(Continued)

FOREIGN PATENT DOCUMENTS

CN 108323841 A 7/2018
KR 100926360 B1 11/2009

OTHER PUBLICATIONS

Phlap, "Face Mask with Mouth Opening/Drinking Slit/Mask with Opening/Washable Mask Reusable Washable Mask/ Mask with Straw Opening", https://www.etsy.com/listing/804767058/face-mask-with-mouth-openingdrinking?ref=listing_page_ad_row-8&plkey=8bb13d8a0deb766fdd481287d1ef5362bf689e07%3A804767058&frs=1 (Year: 2020).*

*Primary Examiner* — Khaled Annis
*Assistant Examiner* — Dakota Marin
(74) *Attorney, Agent, or Firm* — Trojan Law Offices

(57) ABSTRACT

This application is for an improved face mask that allows users to easily transition between a full-protection mode and a partial-protection mode. In full-protection mode, the improved face mask covers a user's mouth area and nose area. In partial-protection mode, a mask hatch removably attached to the mask frame is detached and exposes the (Continued)

user's face covered by the mask frame. A method of manufacturing the improved face mask is also described.

14 Claims, 6 Drawing Sheets

(56) References Cited

U.S. PATENT DOCUMENTS 4,908,878 A * 3/1990 Tarragano ..... A61F 9/04 128/206.13
5,035,006 A * 7/1991 Hetz ..... A41D 15/04 2/209.11
5,704,063 A * 1/1998 Tilden ..... A41D 13/1107 2/9
5,717,991 A * 2/1998 Nozaki ..... A41D 13/113 2/9
5,727,544 A * 3/1998 Miura ..... A41D 13/11 128/201.13
6,173,712 B1 * 1/2001 Brunson ..... A62B 23/025 128/206.19
7,044,127 B1 * 5/2006 Fernandez DeCastro ..... A41D 13/11 128/202.15
7,152,252 B2 * 12/2006 Gellis ..... A41D 13/11 2/206
8,359,669 B2 * 1/2013 Tonegawa ..... A41D 13/113 2/206
8,387,163 B2 * 3/2013 Beliveau ..... A41D 13/11 2/9
8,484,762 B2 * 7/2013 Goldstein ..... A42B 3/20 2/9
10,368,601 B2 * 8/2019 Greenblat ..... A41D 13/1153
10,434,341 B1 * 10/2019 Torbenson ..... A62B 18/00
2017/0095681 A1 * 4/2017 Smaller ..... A41D 13/1161
2017/0128754 A1 5/2017 Hou
2018/0368494 A1 * 12/2018 Henderson ..... A41D 13/1161
2020/0329792 A1 * 10/2020 Howard ..... A41D 13/11

* cited by examiner

FACE MASK

FIELD OF THE INVENTION

This application relates to an improved face mask in which a user can transition between a full-protection mode covering the nose and mouth areas and a partial-protection mode in which the mouth area is exposed.

BACKGROUND OF THE INVENTION

COVID-19 is a global pandemic in which every day face mask wear is the new normal. Face masks are critical for fighting the spread of germs, microbes, viruses, diseases, and their associated pathogens (hereinafter encompassed by "pathogens") while scientists search for a cure and hospitals treat the afflicted. Face masks, however, have introduced unique challenges to once routine activities that require momentary exposure of the face or mouth area.

Manually handling and removing a face mask has numerous disadvantages. Amongst these, contamination of and transfer of pathogens to face masks is a major concern. Removing a face mask also increases outside exposure to all parts of the face mask, including the inside surfaces of the mask that directly contact a user's nasal and mouth areas. A contaminated mask is ineffective at protecting a user from pathogens.

Additionally, removing a face mask adds increased and undesired contact from one's hands. When a user touches a mask with unsanitized hands, especially when donning or doffing the face mask, the user risks contamination of the mask or their hands with pathogens. This renders a face mask ineffective at preventing the transfer of pathogens.

Removing a face mask may also require storing the face mask. When face masks are not being worn, they are generally placed in locations that may not have been sanitized, or may have been exposed to COVID-19 or other pathogens. Such exposure renders a face mask ineffective at preventing the transfer of such pathogens.

Face masks are also contaminated by a user's own aerobic microbes from being worn over the user's face, nose, and mouth. Placing such a face mask onto a foreign surface, such as a table, can contaminate the foreign surface with said microbes. This puts other individuals who subsequently come into contact with that surface at a high risk of coming into contact with and further spreading pathogens such as those associated with COVID-19.

There are numerous examples of situations of users that would benefit from a face mask that can easily transition from a full-protection mode in which a user's nose and mouth areas are covered to a partial-protection mode in which a user's mouth area is exposed. Such examples include athletes and individuals who need to drink water while wearing a face mask; parents who need to remove and replace the face masks of their children when out in public; individuals who need to clearly verbally communicate when a face mask would impede such communication; and individuals who use headwear such as hats, helmets, or goggles and need to wear a face mask, but find it difficult to constantly reposition their equipment. These are just some of the users who would benefit from such an improved face mask that can allow users to temporarily expose their mouth area without removing their mask.

Thus, there is a need for a face mask that can easily transition from a full-protection mode in which a user's nose and mouth areas are covered to a partial-protection mode in which a user's mouth area is exposed. Additionally, there is a need for a face mask that can transition from full-protection mode to partial-protection mode with minimal handling. There is also a need for a face mask that reduces user hand contact when handling the face mask to expose a user's mouth area for various tasks. There is also a need for a face mask that can transition from a full-protection mode to a partial-protection mode while limiting contact of the face mask with foreign objects to prevent contamination. And there is a need for a method to manufacture and create such a face mask as described above.

SUMMARY OF THE INVENTION

The systems and techniques disclosed herein feature an improved face mask in which a user can transition between a full-protection mode in which a protective barrier or mask hatch covers both the nose and mouth areas, and a partial-protection mode in which a user's face is partially exposed for easier access to the mouth area.

In one aspect, the systems and techniques disclosed here feature an improved face mask configured to enable users to transition between a full-protection mode and a partial-protection mode. There is a mask frame. The mask frame can at least partially cover a user's nose area and lower face area. The mask frame can also leave the user's mouth area uncovered. There is also a mask hatch. The mask hatch can cover the mask frame in full-protection mode, and the mask hatch can uncover the mask frame in partial-protection mode. The mask hatch can also be removably attached to the mask frame. A head securing device can secure the mask frame to the user's face.

Implementations may include one or more of the following features.

For example, the mask frame can have a top part at least partially covering the user's nose area, and a bottom part at least partially covering the user's chin area or lower face area. The top part and the bottom part can be adjustably configurable. For example, the top part and the bottom part can be adjustably configurable by moving either the top part or the bottom part. This can, for example, adjust the coverage around the user's mouth area. The mask hatch can be hinged to the mask frame. The mask hatch can cover the user's nose area and mouth area. The mask hatch can also expose the user's face covered by the mask frame. The user's nose area and mouth area can be covered by the mask hatch in full-protection mode. The areas uncovered by the mask frame, such as the user's mouth area, can be exposed to the outside environment in partial-protection mode.

Another feature may be a pull-tab. For example, the mask hatch may have a pull-tab and the pull-tab may be used for easier user control of the mask hatch. The pull-tab can, for example, reduce user hand contact with the mask hatch when a user transitions from full-protection mode to partial-protection mode.

Another feature may be the mask hatch being configured to be folded on itself. For example, the mask hatch can be folded inwardly on itself. This example inward folding can limit outside exposure to the interior surface of the mask hatch when the mask hatch is in partial-protection mode. The mask hatch can be removably attachable to another surface of the improved face mask to secure the folding position. For example, the interior surface of the mask hatch can be attached to another interior surface of the mask hatch for inward folding. In another example, the interior surface of the mask hatch can also be attached to the mask frame for inward folding.

Another feature may be the mask hatch being hinged to the mask frame near one side of the mask frame. By such a hinging, the mask hatch transitions from full-protection mode to partial-protection mode with a side-to-side movement. Another alternative feature may be the mask hatch being hinged to the mask frame near the bottom of the mask frame. By such a hinging, the mask hatch transitions from full-protection mode to partial-protection mode with a top-to-bottom movement.

Another feature may be the mask hatch being removably attachable by a hook-and-loop fastener such as Velcro®. Another alternative feature may be the mask hatch being removably attachable by a snap fastener.

Another feature may be the head securing device being a back enclosure. Another alternative feature may be the head securing device being ear loops. Another alternative feature may be the head securing device being a back enclosure with ear loops.

Another feature may be the top part and the bottom part of the mask frame being independent from each other. Another feature may be the top part and the bottom part of the mask frame being adjustably configurable. For example, the top part and the bottom part can be adjustably configurable by moving either the top part or the bottom part.

Another feature may be the mask hatch being configured to be secured in an open position. For example, in partial-protection mode, the mask hatch can be removably attachable to another surface of the improved face mask to be secured while in an open position. For example, the mask hatch can be removably attachable to the head securing device, for example, the back enclosure.

In another aspect, the systems and techniques disclosed here feature a method of manufacturing an improved face mask. The method can include cutting a mask frame top part textile to size to form a mask frame top part, cutting a mask frame bottom part textile to size to form a mask frame bottom part, cutting a head securing device part textile to size to form a head securing device part, and installing the mask frame top part, the mask frame bottom part, and the head securing device part together to form a mask frame. The installation can be such that the mask frame is formed with an adjustable mouth area gap between the mask frame top part and the mask frame bottom part. The method can also include cutting a mask hatch part textile to size to form a mask hatch part, installing the mask hatch part to a side of the mask frame, and installing materials for removable attachment to the mask hatch part and the mask frame. The installation can be such that the mask hatch part can be removably attached in a full-protection mode and the mask hatch part can be removed or partially removed from the mask frame in a partial-protection mode.

Implementations may include one or more of the following features.

For example, the method may further include cutting an ear loop part textile to size to form an ear loop part and installing the ear loop part to the mask frame.

Another feature may be the method further including cutting a pull-tab part textile to size to form a pull-tab part and installing the pull-tab part to the mask hatch part.

Another feature may be the method further including installing the materials for removable attachment within an interior surface of the mask hatch part, and further installing the materials for removable attachment within another interior surface of the mask hatch. The installation may be such that the mask hatch can be folded on itself and removably attached on itself.

DETAILED DESCRIPTION OF THE INVENTION

FIGS. 1 through 5 demonstrate an improved face mask 1 with a side-to-side mask hatch 2 shown from various perspectives and in various modes of operation.

Figure 1:
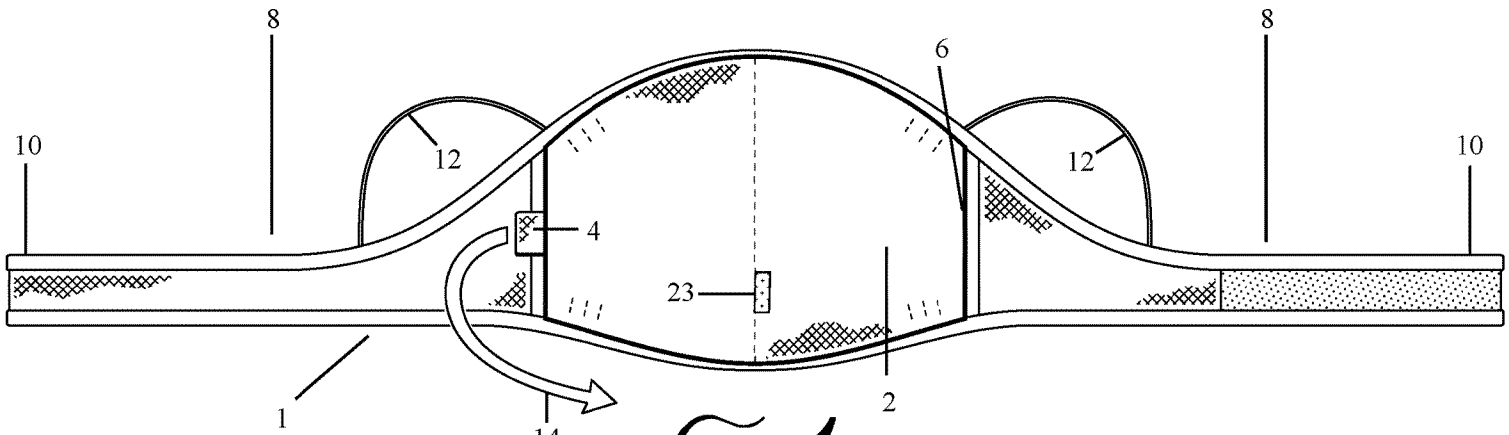
FIG. 1 is a front perspective view of an embodiment of the improved face mask with a side-to-side mask hatch in full-protection mode and an arrow illustrating movement of the same to transition to partial-protection mode.

FIG. 1 demonstrates improved face mask 1 in full-protection mode with side-to-side mask hatch 2. In full-protection mode, mask hatch 2 covers mask frame 16. Pull-tab 4 attached to mask hatch 2 enables a user to actuate control of mask hatch 2 with minimal contact to mask hatch 2. Pull-tab 4 is shown in an embodiment attached to the side of mask hatch 2. Mask hatch 2 is attached to mask frame 16 at side-to-side hinge 6. Mask hatch 2 can pivot around hinge 6. Head securing device 8 is shown in an embodiment with back enclosure 10 and ear loops 12. Movement arrow 14 is shown for demonstrative purposes to illustrate a motion of mask hatch 2 about hinge 6. Hatch attachment point 23 shown in the middle of mask hatch 2 can removably attach to back enclosure 10.

Figure 2:
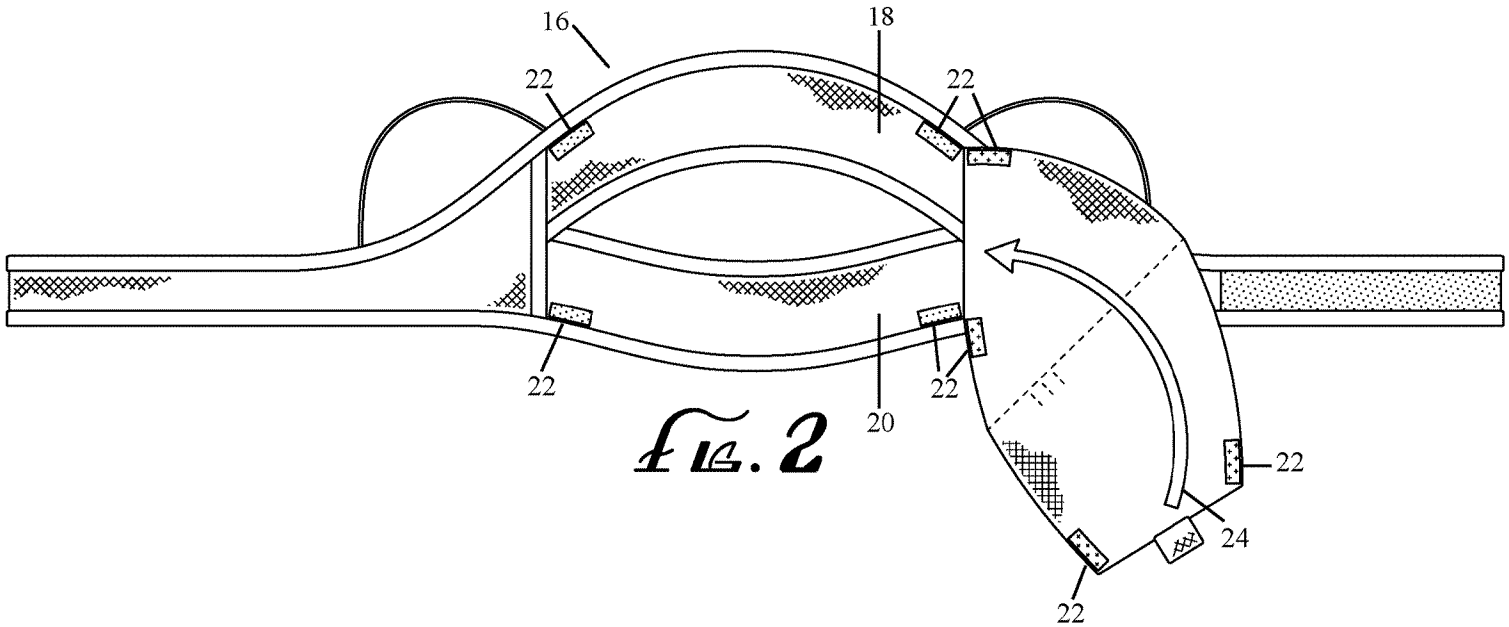
FIG. 2 is a front perspective view of the improved face mask of FIG. 1 in partial-protection mode and an arrow illustrating movement of the side-to-side mask hatch for folding on itself.

FIG. 2 demonstrates improved face mask 1 in partial-protection mode with side-to-side mask hatch 2. In partial-protection mode, mask hatch 2 uncovers mask frame 16. Mask frame 16 is shown in an embodiment with top part 18 and bottom part 20. Top part 18 and bottom part 20 can be adjustably configurable with respect to each other. For example, the space between top part 18 and bottom part 20 can be adjusted to be bigger or smaller. Mode attachment points 22 on mask frame 16 and mask hatch 2 enable the same to be removably attachable. Hence, mask hatch 2 can be attached to mask frame 16 in full-protection mode and detached from mask frame 16 in partial-protection mode. Mode attachment points 22 can, for example, be hook-and-loop fasteners or snap fasteners. Movement arrow 24 is shown for demonstrative purposes to illustrate a motion of mask hatch 2 being folded on itself. Mask hatch 2 can also be folded on itself and secured for the same with mode attachment points 22.

Figure 4:
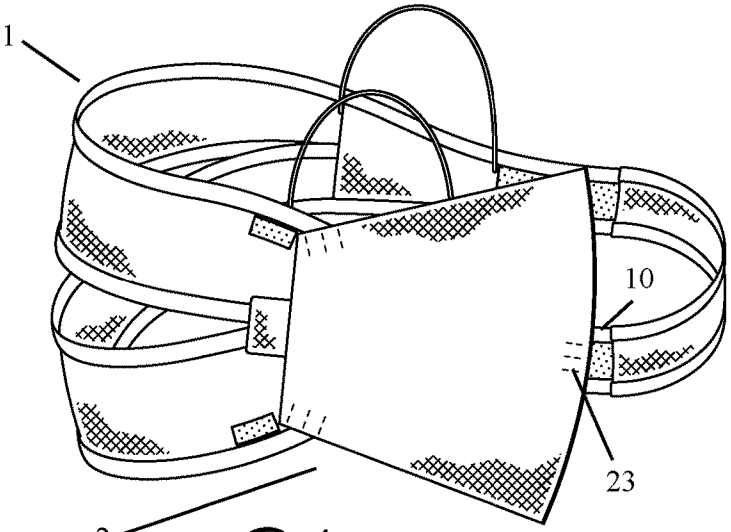
FIG. 4 is a side perspective view of the improved face mask of FIG. 1 in partial-protection mode and the side-to-side mask hatch folded on itself.
Figure 3:
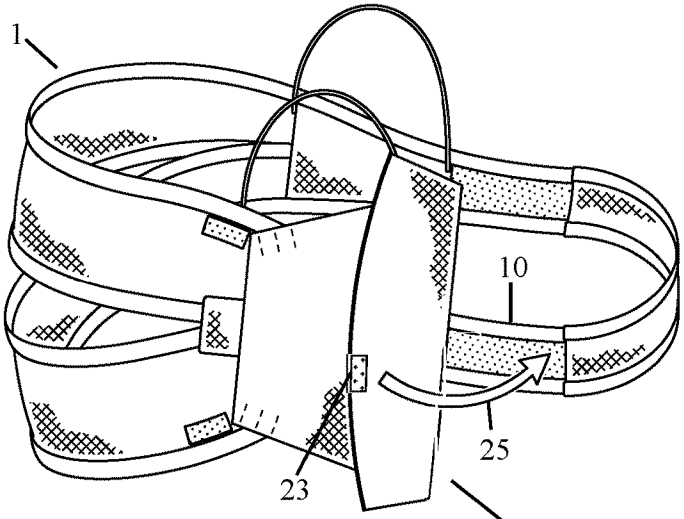
FIG. 3 is a side perspective view of the improved face mask of FIG. 1 in partial-protection mode and an arrow illustrating movement of the side-to-side mask hatch for folding on itself.
Figure 5:
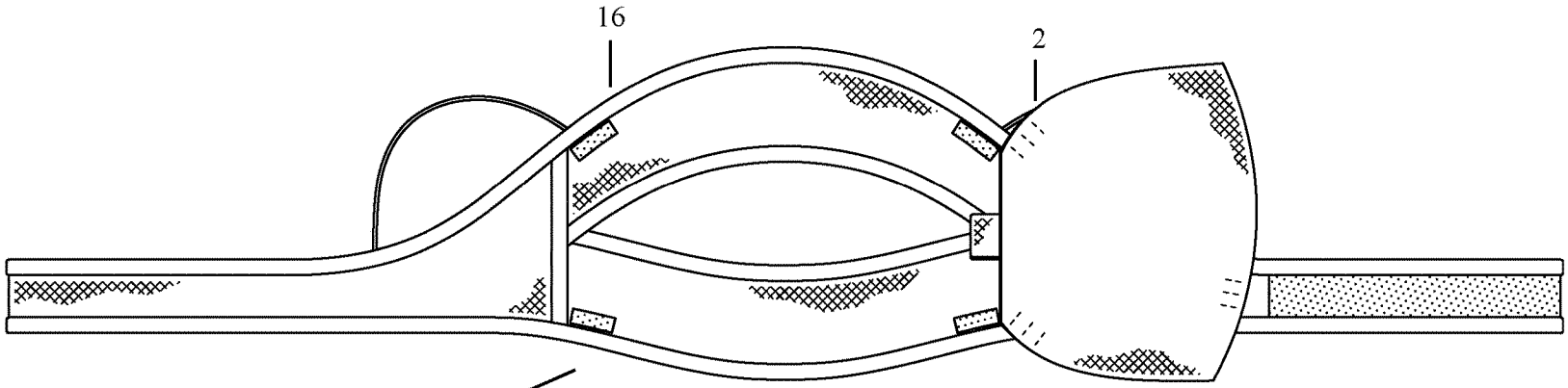
FIG. 5 is a front perspective view of the improved face mask of FIG. 1 in partial-protection mode and the side-to-side mask hatch folded on itself.

FIGS. 3 through 5 demonstrate various views of improved face mask 1 in partial-protection mode with the mask hatch 2 folded on itself. FIGS. 3 and 4 demonstrate from side view perspective mask hatch 2 folded on itself. In this configuration, the inner surface of mask hatch 2 is less exposed to outside elements while the improved face mask 1 is in partial-protection mode. FIG. 3 demonstrates an unobstructed view of hatch attachment point 23. Movement arrow 25 is shown for demonstrative purposes to illustrate a motion of hatch attachment point 23 being removably attached to back enclosure 10. FIG. 4 demonstrates hatch attachment point 23 removably attached to back enclosure 10. FIG. 5 demonstrates from a front view perspective improved face mask 1 in partial-protection mode and mask hatch 2 folded on itself. Mask frame 16 is uncovered by mask hatch 2.

Figures 6, 7, 8:
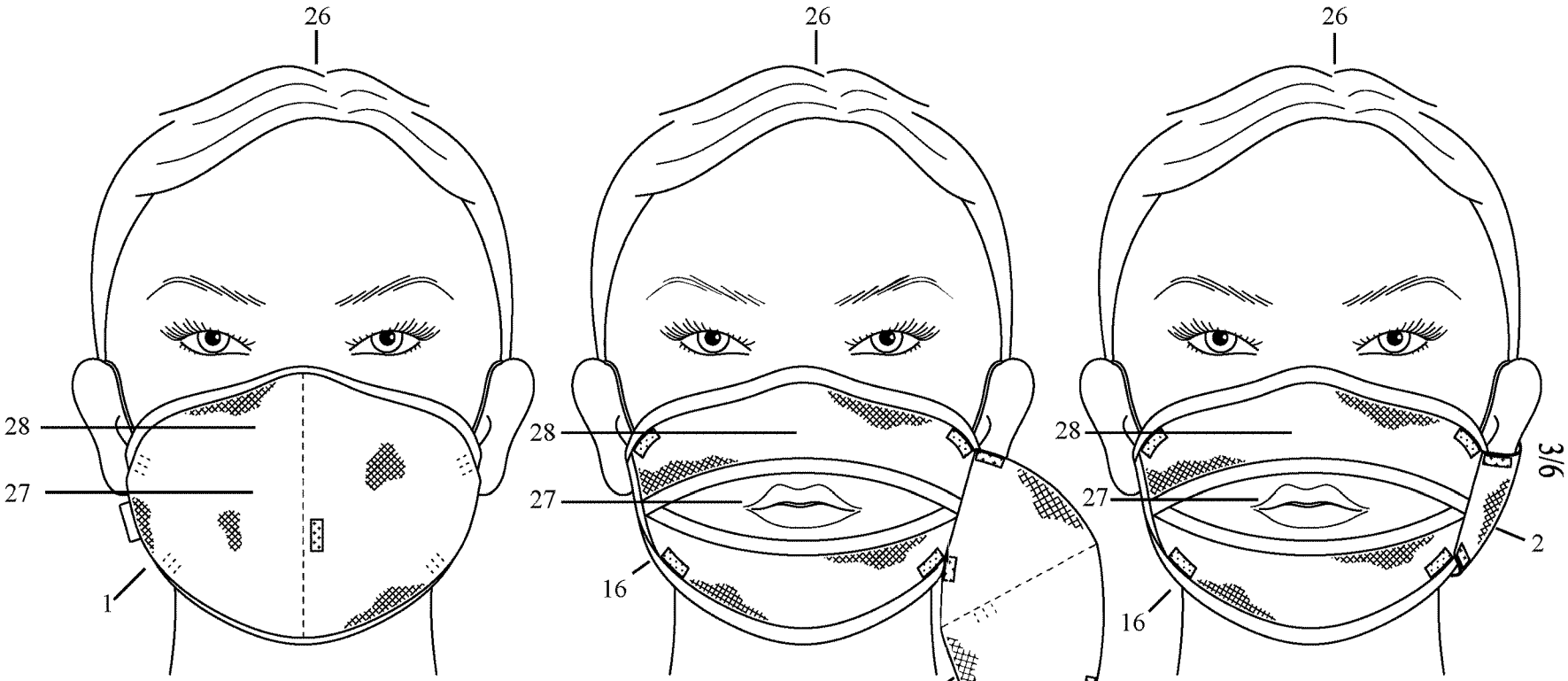
FIG. 6 is a front perspective view of the improved face mask of FIG. 1 in full-protection mode as worn by a model.
FIG. 7 is a front perspective view of the improved face mask of FIG. 1 in partial-protection mode as worn by a model.
FIG. 8 is a front perspective view of the improved face mask of FIG. 1 in partial-protection mode and the side-to-side mask hatch being held open as worn by a model.

FIGS. 6 through 8 demonstrate improved face mask 1 as worn by a model user 26 in various modes of operation.

FIGS. 6 through 8 demonstrate the improved face mask 1 as worn by model user 26 respectively shown in full-protection mode, partial-protection mode, and partial-protection mode with mask hatch 2 held open. In full-protection mode, as shown in FIG. 6, both mouth area 27 and nose area 28 are covered. In partial-protection mode, as shown in FIGS. 7 and 8, mask hatch 2 is open and mask frame 16 at least partially covers the model user's 26 face. As shown in FIGS. 7 and 8, mouth area 27 is exposed to the outside environment while nose area 28 is at least partially covered by mask frame 16. FIG. 8 demonstrates mask hatch 2 held open by removeable attachment of hatch attachment point 23 and back enclosure 10.

FIGS. 9 through 14 demonstrate another improved face mask 30 with a top-to-bottom mask hatch 32 shown in various modes of operation.

Figure 9:
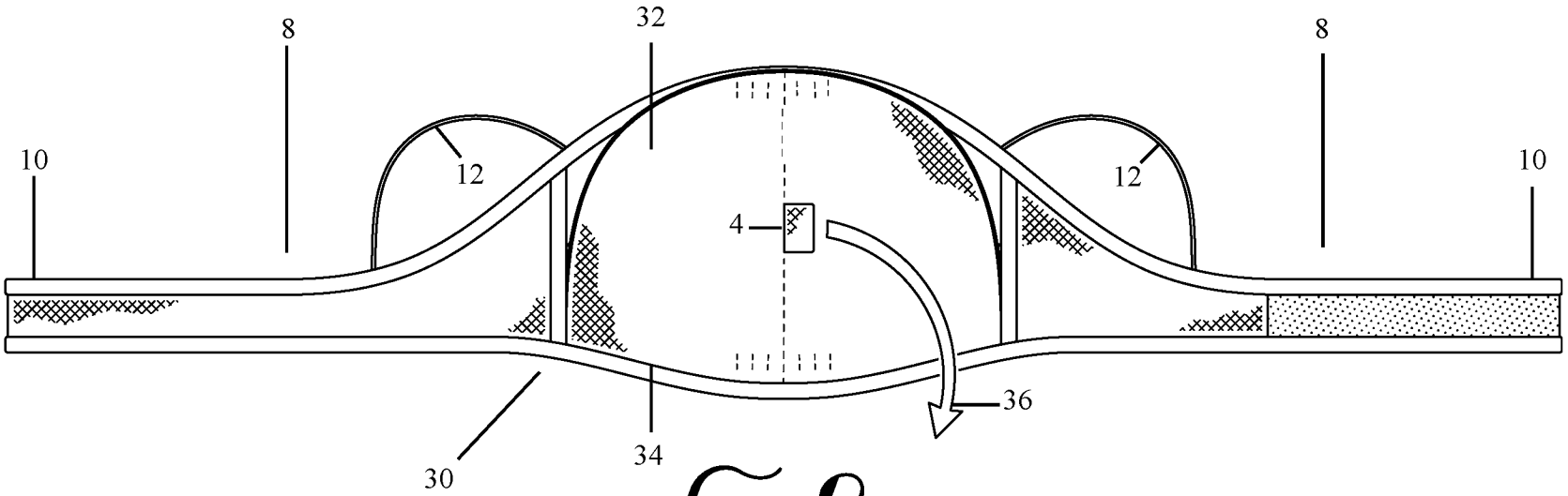
FIG. 9 is a front perspective view of another embodiment of the improved face mask with a top-to-bottom mask hatch in full-protection mode and an arrow illustrating movement of the same to transition to partial-protection mode.

FIG. 9 demonstrates improved face mask 30 in full-protection mode with top-to-bottom mask hatch 32. In full-protection mode, mask hatch 32 covers mask frame 16. Pull-tab 4 attached to mask hatch 32 enables a user to actuate control of mask hatch 32 with minimal contact with mask hatch 32. Pull-tab 4 is shown in an embodiment attached in the middle of mask hatch 32. Mask hatch 32 is attached to mask frame 16 at top-to-bottom hinge 34. Mask hatch 32 can pivot around hinge 34. Head securing device 8 is shown in an embodiment with back enclosure 10 and ear loops 12. Movement arrow 36 is shown for demonstrative purposes to illustrate a motion of mask hatch 32 about hinge 34.

Figure 10:
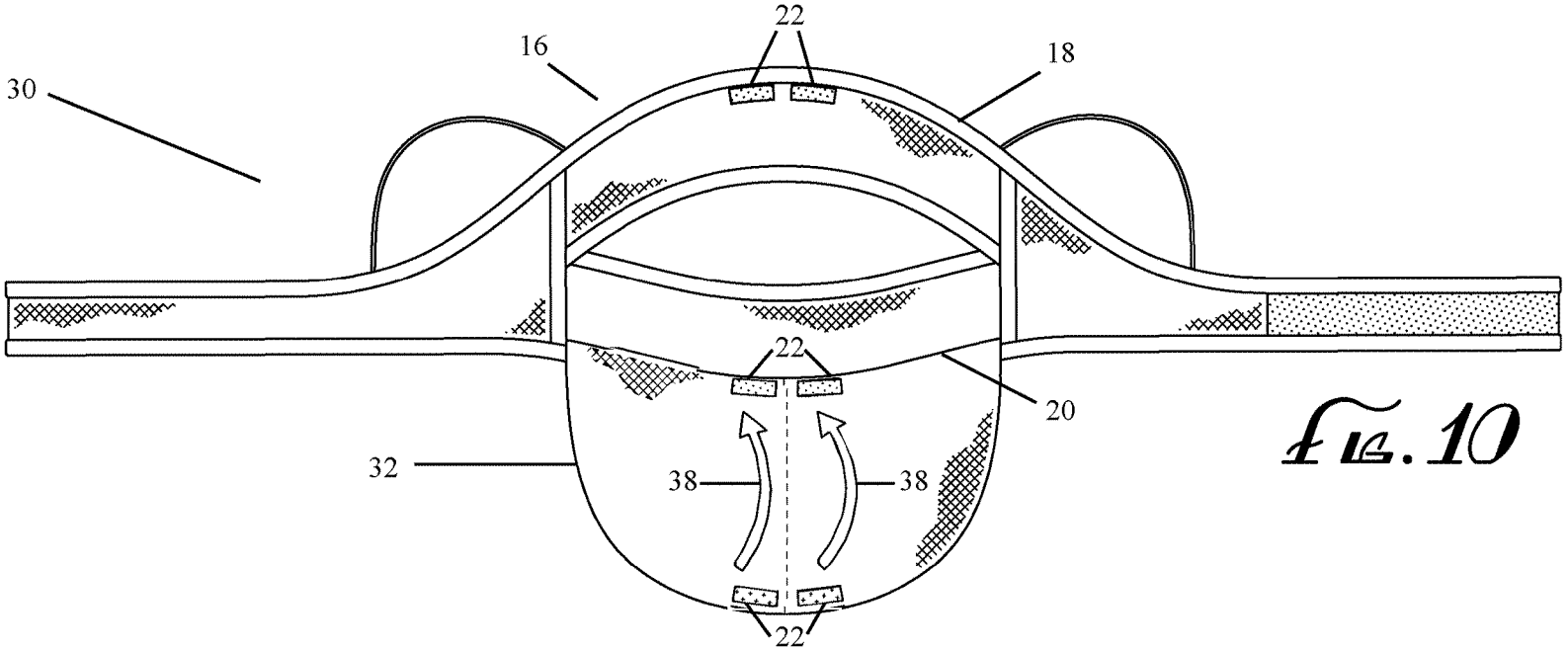
FIG. 10 is a front perspective view of the improved face mask of FIG. 9 in partial-protection mode and an arrow illustrating movement of the top-to-bottom mask hatch for folding on itself.

FIG. 10 demonstrates improved face mask 30 in partial-protection mode. In partial-protection mode, mask hatch 32 uncovers mask frame 16. Mask frame 16 is shown in an embodiment with top part 18 and bottom part 20. Top part 18 and bottom part 20 can be adjustably configurable with respect to each other. For example, the space between top part 18 and bottom part 20 can be adjusted to be bigger or smaller. Mode attachment points 22 on mask frame 16 and mask hatch 32 enable the same to be removably attachable. Mask hatch 32 can be attached to mask frame 16 in full-protection mode and detached from mask frame 16 in partial-protection mode. Mode attachment points 22 can, for example, be hook-and-loop fasteners or snap fasteners.

FIG. 10 movement arrows 38 are shown for demonstrative purposes to illustrate a motion of mask hatch 32 being folded on itself. In partial-protection mode, the inner surface of mask hatch 32 can be exposed. Mask hatch 32 can also be folded on itself and secured for the same with mode attachment points 22. In this configuration, the inner surface of mask hatch 32 is less exposed to outside elements while the improved face mask 30 is in partial-protection mode.

Figure 11:
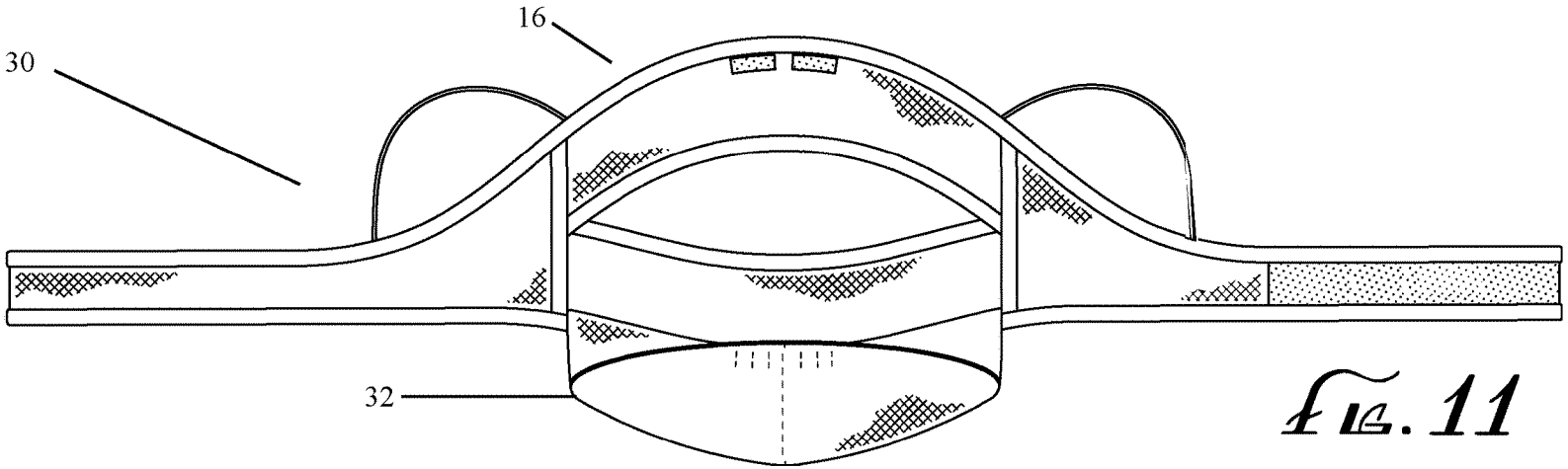
FIG. 11 is a front perspective view of the improved face mask of FIG. 9 in partial-protection mode and the top-to-bottom mask hatch folded on itself.

FIG. 11 demonstrates from a front view perspective improved face mask 30 in partial-protection mode and mask hatch 32 being folded on itself. Mask frame 16 is uncovered by mask hatch 32.

Figure 14:
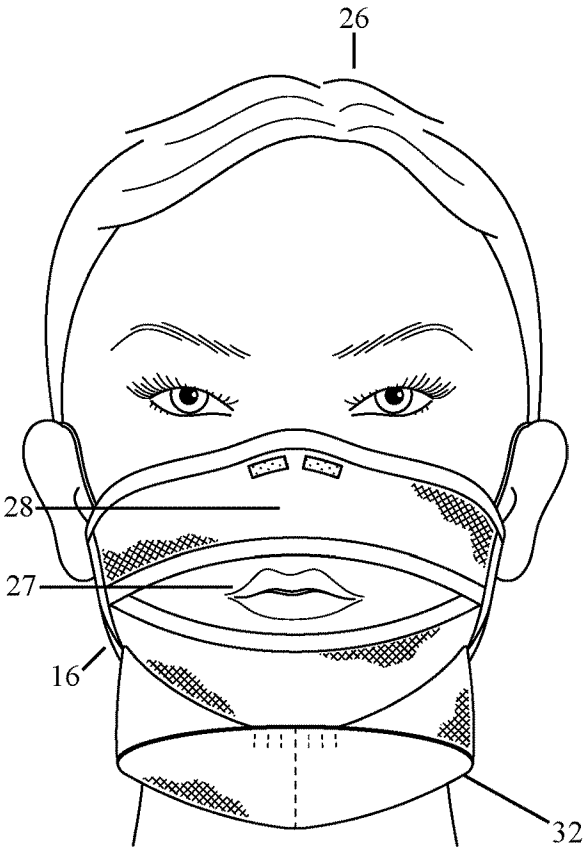
FIG. 14 is a front perspective view of the improved face mask of FIG. 9 in partial-protection mode and the top-to-bottom mask hatch folded on itself as worn by a model.
Figure 13:
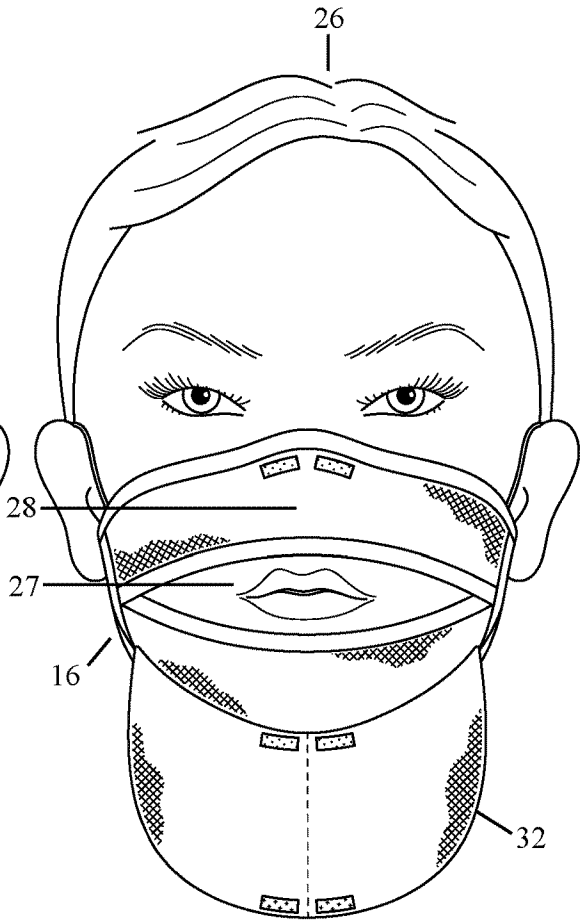
FIG. 13 is a front perspective view of the improved face mask of FIG. 9 in partial-protection mode as worn by a model.
Figure 12:
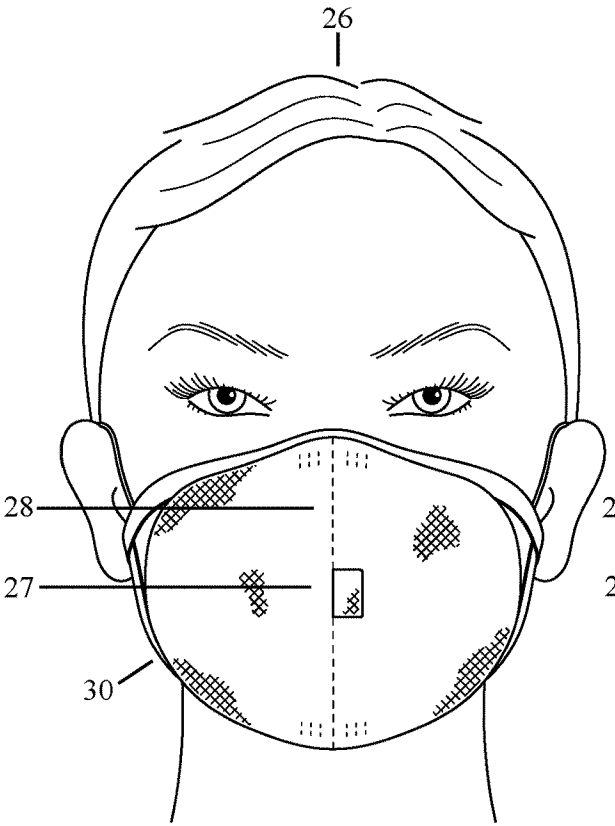
FIG. 12 is a front perspective view of the improved face mask of FIG. 9 in full-protection mode as worn by a model.

FIGS. 12 through 14 demonstrate improved face mask 30 as worn by a model user 26 in various modes of operation.

FIGS. 12 through 14 demonstrate improved face mask 30 as worn by model user 26 respectively shown in full-protection mode, partial-protection mode, and partial-protection mode with mask hatch 32 folded on itself. In full-protection mode, as shown in FIG. 12, both mouth area 27 and nose area 28 are fully covered. In partial-protection mode, as shown in FIGS. 13 and 14, mask hatch 32 is open and mask frame 16 at least partially covers the model user's 26 face. As shown in FIGS. 13 and 14, mouth area 27 is exposed to the outside environment while nose area 28 is at least partially covered by mask frame 16. FIG. 14 demonstrates mask hatch 32 held folded and secured by mode attachment points 22.

We claim:

1. An improved face mask configured to enable users to transition between a full-protection mode and a partial-protection mode, comprising:

a mask frame;

wherein said mask frame at least partially covers said user's nose area and lower face area; and, wherein said mask frame leaves said user's mouth area uncovered;

a mask hatch having an inner surface, at least one mode attachment point positioned on an end of said inner surface, and at least one mode attachment point positioned on an opposing end of said inner surface;

wherein said mask hatch covers said mask frame in said full-protection mode;

wherein said mask hatch uncovers said mask frame in said partial-protection mode;

wherein said mask hatch is removably attachable to said mask frame; and, a head securing device that secures said mask frame to said user's face;

wherein when said improved face mask is in said partial-protection mode, said mask hatch folds onto itself such that said at least one mode attachment point positioned on said end of said inner surface aligns with and removably attaches to said at least one mode attachment point positioned on said opposing end of said inner surface, thereby preventing said inner surface of said mask hatch from environmental exposure.

2. The improved face mask of claim 1, further comprising:

said mask frame having a top part at least partially covering said user's nose area;

said mask frame having a bottom part at least partially covering said user's chin area;

said top part and said bottom part are adjustably configurable;

said mask hatch is hinged to said mask frame;

said mask hatch covers said user's nose area and mouth area in said full-protection mode; and, said mask hatch uncovers said user's nose area and mouth area in said partial-protection mode.

3. The improved face mask of claim 1, further comprising:

said mask hatch has a pull-tab.

4. The improved face mask of claim 1, further comprising:

said mask hatch is hinged to said mask frame near one side of said mask frame such that said mask hatch transitions from said full-protection mode to said partial-protection mode with a side-to-side movement.

5. The improved face mask of claim 1, further comprising:

said mask hatch is hinged to said mask frame near the bottom of said mask frame such that said mask hatch transitions from said full-protection mode to said partial-protection mode with a top-to-bottom movement.

6. The improved face mask of claim 1, further comprising:

said mask hatch is removably attachable by at least one hook-and-loop fastener.

7. The improved face mask of claim 1, further comprising:

said mask hatch is removably attachable by at least one snap fastener.

8. The improved face mask of claim 1, wherein the head securing device comprises a back enclosure.

9. The improved face mask of claim 1, wherein the head securing device comprises ear loops.

10. The improved face mask of claim 1, wherein said head securing device comprises a back enclosure with ear loops.

11. The improved face mask of claim 1, further comprising:

said mask hatch is removably attachable to said head securing device.

12. An improved face mask configured to enable users to transition between a full-protection mode and a partial-protection mode, comprising:

a mask frame;

said mask frame having a top part at least partially covering said user's nose area;

said mask frame having a bottom part at least partially covering said user's lower face area;

wherein said top part and said bottom part are independent of each other; and wherein said top part and said bottom part are adjustably configurable;

a head securing device that secures said mask frame to said user's face; and, a mask hatch;

wherein said mask hatch is hinged to said mask frame;

said mask hatch is removably attachable to said mask frame;

said mask hatch covers said user's nose area and mouth area in said full-protection mode;

said mask hatch uncovers said mask frame in said partial-protection mode; and, said mask hatch has a pull-tab, wherein said mask hatch is configured to be folded on itself;

said mask hatch is removably attachable to itself; and, said mask hatch is removably attachable to said head securing device.

13. The improved face mask of claim 12, further comprising:

said mask hatch is hinged to said mask frame near one side of said mask frame such that said mask hatch transitions from said full-protection mode to said partial-protection mode with a side-to-side movement.

14. The improved face mask of claim 12, further comprising:

said mask hatch is hinged to said mask frame near the bottom of said mask frame such that said mask hatch transitions from said full-protection mode to said partial-protection mode with a top-to-bottom movement.

* * * * *